US005307573A

United States Patent [19]

Watkins

[11] Patent Number: 5,307,573

[45] Date of Patent: May 3, 1994

[54] STEAM BURST IRON WITH PUMP INLET TUBE WITHIN INCLINED RESERVOIR FLOOR

[75] Inventor: Edwin Watkins, Highland Park, N.J.

[73] Assignee: The Singer Company N.V., Curacao, Netherlands

[21] Appl. No.: 964,689

[22] Filed: Oct. 22, 1992

[51] Int. Cl.[5] ..... D06F 75/14; D06F 75/20

[52] U.S. Cl. ..... 38/77.8; 38/77.82; 38/77.83

[58] Field of Search ..... 38/74, 77.1, 77.5, 77.8, 38/77.83, 77.9, 88, 77.82; 219/245, 254; 392/392, 398, 404

[56] References Cited

U.S. PATENT DOCUMENTS

| | | | |
|---|---|---|---|
| 2,515,776 | 7/1950 | Kassab | 392/404 X |
| 3,375,599 | 4/1968 | Trouichet | 38/77.1 |
| 3,620,055 | 11/1971 | Blachly et al. | 392/404 X |
| 3,811,208 | 5/1974 | Vieceli et al. | 38/88 X |
| 4,107,860 | 8/1978 | Coggiola | 38/77.83 |
| 4,398,364 | 8/1983 | Augustine et al. | 38/77.5 |
| 4,594,801 | 6/1986 | Gronwick et al. | 38/77.5 X |
| 4,843,215 | 6/1989 | Wilkins | 392/404 X |
| 5,063,697 | 11/1991 | Valente et al. | 38/77.8 X |

FOREIGN PATENT DOCUMENTS 2298399 12/1987 Japan ..... 38/77.7

*Primary Examiner*—Clifford D. Crowder
*Assistant Examiner*—Ismael Izaguirre

[57] ABSTRACT

A steam burst electric iron utilizes a flat horizontal sole plate with a pointed front end and provided with a plurality of steam ports. A hollow body having a top disposed handle is disposed above and is secured to the sole plate. The portion of the body which is secured to the plate is congruent therewith. The front end of the body is disposed above the plate and contains a water inlet port. A water reservoir is disposed in the body. The reservoir is connected to the inlet port and has a floor which extends longitudinally through a major portion of the body. The reservoir has a front end communicating with the inlet port and has an opposite rear end. The floor is longitudinally inclined downwardly toward the rear end and contains a longitudinal recess extending between the front and rear ends of the reservoir. A manually operated steam burst pump has an actuating button disposed in the handle. The pump has an inlet and an outlet and extends downwardly in the body. An elongated hollow pump extension tube has opposite open ends, one tube end being secured to the pump inlet. The tube is disposed in the recess with the other tube end being disposed adjacent the rear end of the reservoir.

1 Claim, 3 Drawing Sheets

STEAM BURST IRON WITH PUMP INLET TUBE WITHIN INCLINED RESERVOIR FLOOR

BACKGROUND OF THE INVENTION

A known type of steam burst electric iron is provided with a manually operated steam burst pump whereby when the iron is held in horizontal position and the pump is actuated, a burst of steam is discharged from at least one steam port in its sole plate. There is a need for a steam iron of this type which can be used to produce a burst of steam when the iron is held vertically so that the iron can also be used as a steamer for vertical curtains or the like. However, because of the structure employed in the steam burst operation, this type of iron cannot be used as such a steamer.

The present invention is directed toward a new and improved steam iron which not only can be used for ironing in conventional manner but also can be used as a steamer to produce steam bursts when held vertically,

SUMMARY OF THE INVENTION

It is an object of the present invention to provide a new and improved steam burst electric iron which can be used as a steamer to produce steam bursts when held vertically.

Another object is to provide a new and improved steam burst electric iron employing a water reservoir wherein essentially all of the water in the reservoir can be used for producing bursts of steam when the iron is disposed vertically for use as a steamer.

Still another object is to provide a new and improved steam burst electric iron of the character indicated which is characterized by a novel arrangement of water reservoir and pump extension water feed tube.

These and other objects and advantages of the invention will either be explained or will become apparent hereinafter.

In accordance with the principles of this invention, a steam electric iron utilizes a flat horizontal sole plate with a pointed front end and provided with a plurality of steam ports. A U shaped electric heating element is set into the plate.

A hollow body having a top disposed handle is disposed above and is secured to the sole plate. The portion of the body which is secured to the plate is congruent therewith. The front end of the body disposed above the plate contains a water inlet port.

A water reservoir is disposed in the body. The reservoir is connected to the inlet port and has a floor which extends longitudinally through a major portion of the body. The reservoir has a front end communicating with the inlet port and also has an opposite rear end.

A manually operated steam burst pump has an actuating button disposed in the handle. The pump has an inlet and an outlet and extends downwardly in the body.

An elongated hollow pump extension tube has opposite open ends, one tube end being secured to the pump inlet. The tube extends longitudinally within the reservoir along the floor with the other tube end being disposed adjacent the rear end of the reservoir.

A vapor chamber in the body is disposed adjacent the heating element with a discharge opening connected to at least one selected steam port in the plate.

A spray burst feed tube is connected between the outlet of the pump and said chamber whereby when the pump is actuated, water is fed from the reservoir via the extension tube through the pump and feed tube into the vapor chamber where the water contacts the element and is converted to a burst of steam which is discharged through the selected steam port.

In view of the relationship between the pump extension feed tube and the reservoir, when the iron is disposed vertically, water can be drawn out of the reservoir by pump action as long as there is any water in the reservoir. Consequently, the iron can be used as a steamer when held in vertical position.

DETAILED DESCRIPTION OF PREFERRED EMBODIMENT

Figure 1:
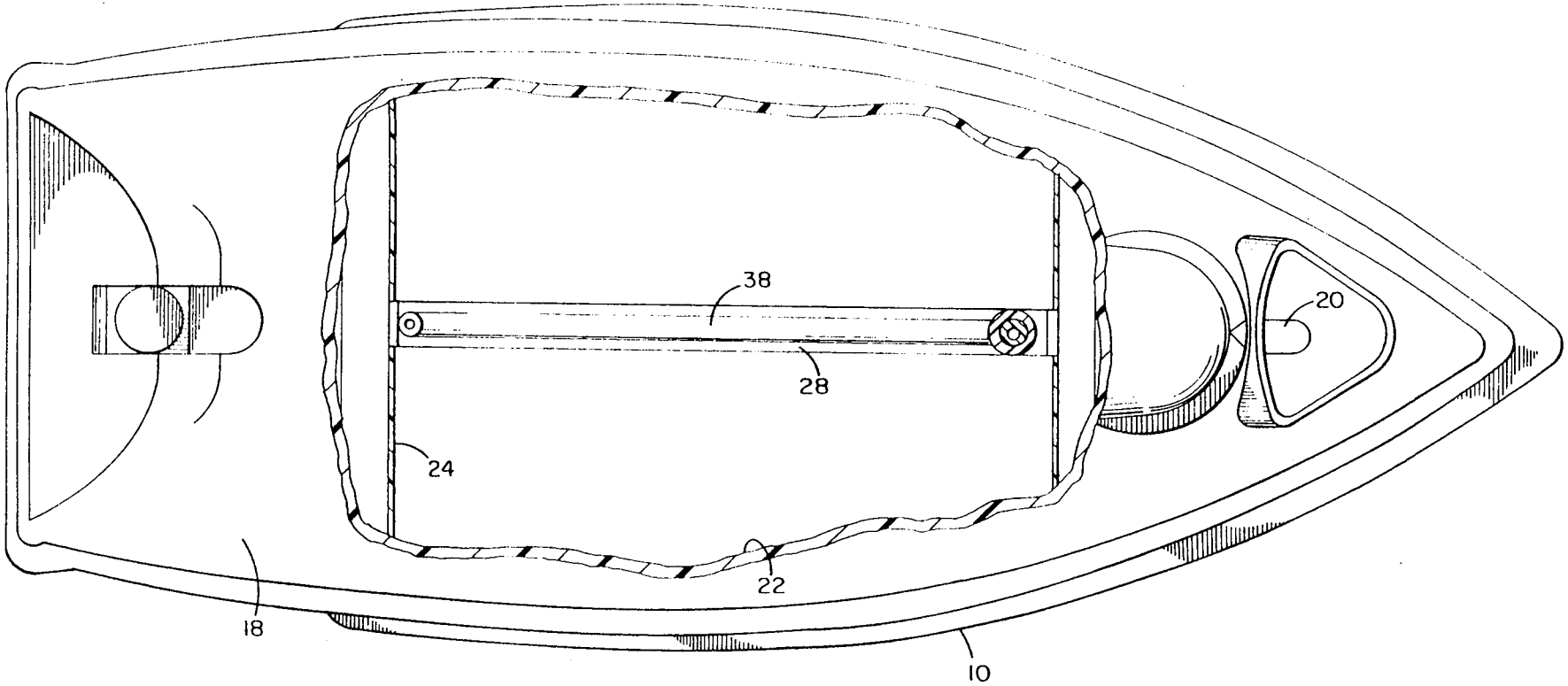
FIG. 1 is a partially cut away top plan view of a preferred embodiment of the invention.
Figure 2:
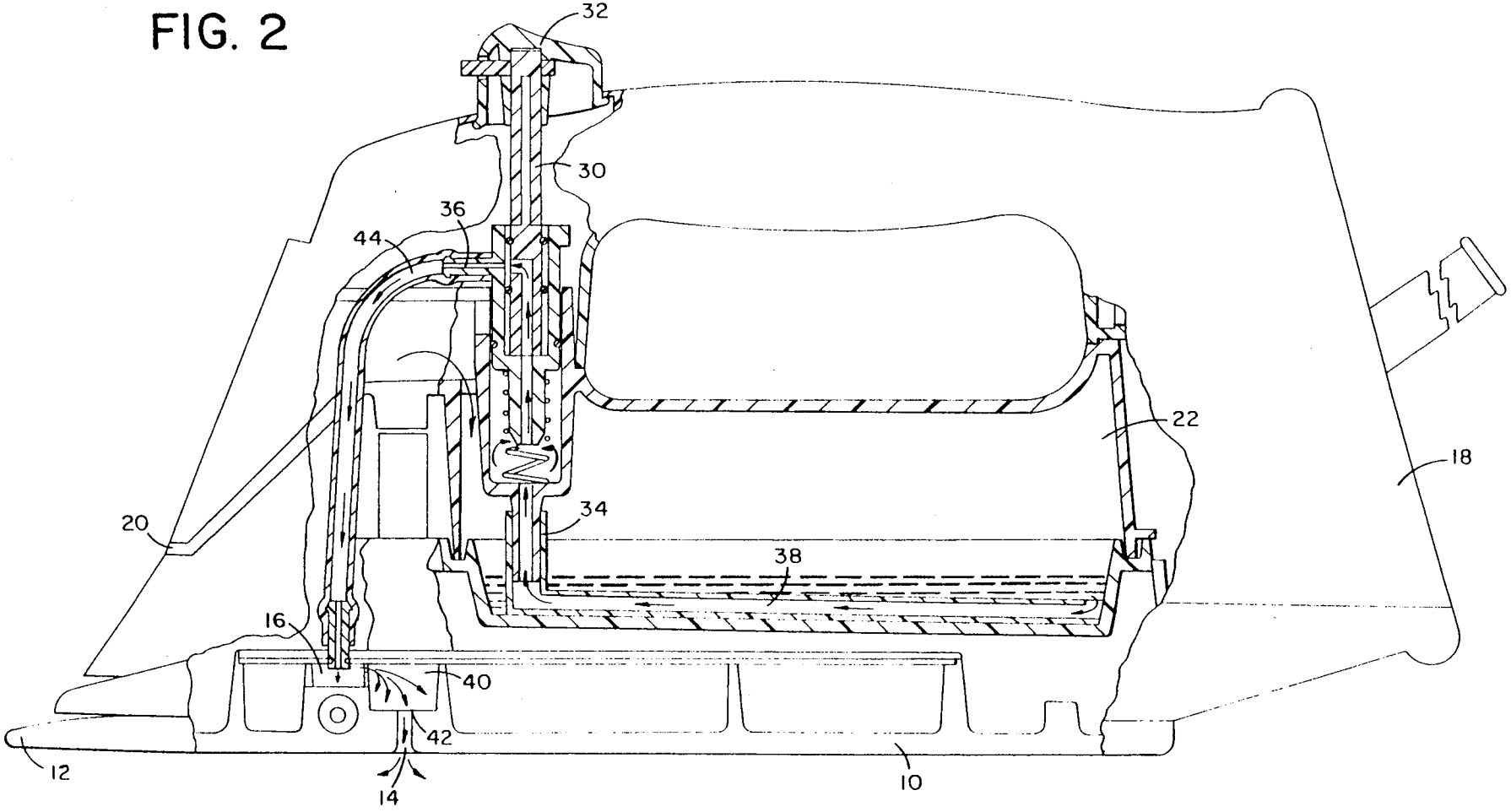
FIG. 2 is a vertical longitudinal cross sectional view of the preferred embodiment shown in FIG. 1.
Figure 3:
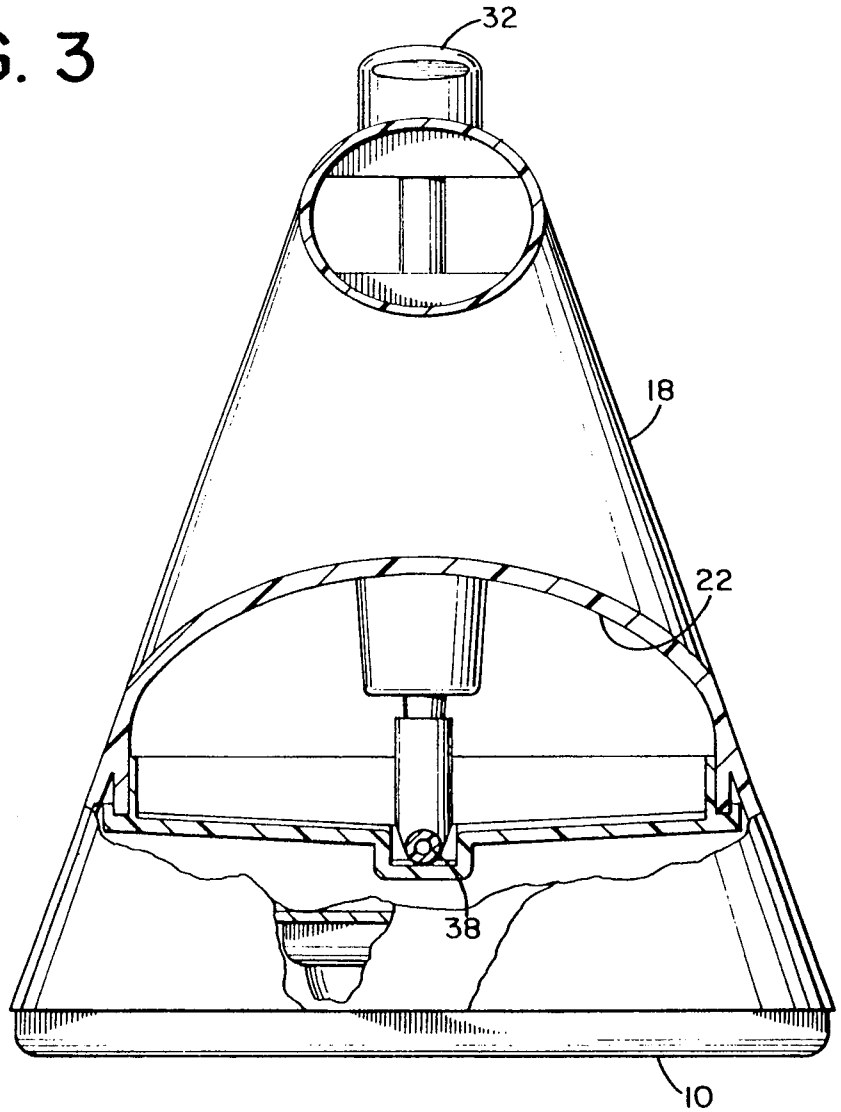
FIG. 3 is a vertical lateral cross sectional view of the preferred embodiment shown in FIG. 1.

Referring now to FIGS. 1–3, 1. a steam burst electric iron in accordance with the invention employs a flat horizontal sole plate 10 which has a pointed front end 12 and is provided with a plurality of steam ports 14. A U shaped electric heating element 16 is set into the plate;

A hollow body 18 has a top disposed handle and is disposed above and secured to the sole plate. The portion of the body which is secured to the plate is congruent therewith. The front end of the body disposed above the plate contains a water inlet port 20.

A water reservoir 22 is disposed in the body. The reservoir is connected to the inlet port and has a floor 24 which extends longitudinally through a major portion of the body. The reservoir has a front end communicating with the inlet port via path 26 and an opposite rear end. The floor of the reservoir is inclined longitudinally downward toward the rear end of the reservoir. The reservoir has a recess 28 which extends longitudinally between the front and rear ends.

A manually operated steam burst pump 30 has an actuating button 32 disposed in the handle. The pump has an inlet 34 and an outlet 36 and extends downwardly in the body.

An elongated hollow pump extension tube 38 is disposed in the recess 28 of the floor. Tube 38 has opposite open ends, one tube end being secured to the pump inlet 34. The tube extends longitudinally within the reservoir along the recess with the other tube end being disposed adjacent the rear end of the reservoir. Hence, when the iron is disposed vertically, water can be drawn out of the reservoir by pump action as long as there is any water in the reservoir.

A vapor chamber 40 in the body is disposed adjacent the heating element with a discharge opening 42 connected to at least one selected steam port in the plate.

A spray burst feed tube 44 is connected between the outlet of the pump and the chamber. When the pump is actuated, water is fed from the reservoir via the extension tube through the pump and feed tube into the vapor chamber where the water contacts the element and is converted to a burst of steam which is discharged though the selected steam port.

This burst of steam will be produced when the iron is held vertically or horizontally. The combination of the length of the extension tube and the pitch of the floor of the reservoir insures that vertually all of the water in the reservoir can be used in producing burst of steam.

While the invention has been described with particular reference to the drawings, the protection sought is to be limited only by the terms of the claims which follow.

What is claimed is:

1. An iron comprising:

a flat horizontal longitudinally extending sole plate with a pointed front end and provided with a plurality of steam ports;

a hollow longitudinally extending body having a top disposed handle and disposed above and secured to the sole plate, a portion of the body which is secured to the plate being congruent therewith, the front end of the body being disposed above the plate and containing a water inlet port;

a water reservoir disposed and extending longitudinally in the body, the reservoir having a front end connected to the inlet port and having an opposite rear end, the reservoir having a floor which extends longitudinally between the front and rear ends and inclines smoothly and continuously from the front end to the rear end, the floor containing a longitudinally extending recess which inclines smoothly and continuously from the front end to the rear end;

a manually operated steam burst pump having an actuating button disposed in the handle, the pump having an inlet and an outlet and extending downwardly in the body;

means connecting the outlet of the pump to the steam ports in the sole plate; and an elongated hollow pump extension tube having opposite open ends, one tube end being secured to the pump inlet, the tube being disposed in the recess with the other tube end being disposed adjacent the rear end of the reservoir.

* * * * *